US005379486A

United States Patent [19]

Wang

[11] Patent Number: 5,379,486

[45] Date of Patent: Jan. 10, 1995

[54] PULL HANDLE OF A TRUNK

[76] Inventor: Chien-shan Wang, No. 17, Nan Fang Lin 2, Fang Li Li, Yuan-Li Chen, Miao Li Hsien, Taiwan, Prov. of China

[21] Appl. No.: 108,171

[22] Filed: Aug. 18, 1993

[51] Int. Cl.[6] ..... B25G 1/04

[52] U.S. Cl. ..... 16/115

[58] Field of Search ..... 16/115, 110 R, 111 R; 190/18 A

[56] References Cited

U.S. PATENT DOCUMENTS

| | | | |
|---|---|---|---|
| 618,159 | 1/1899 | Antes | 16/115 |
| 1,202,601 | 10/1916 | Snyder | 16/115 |
| 4,256,320 | 3/1981 | Hager | 16/115 |
| 4,616,379 | 10/1986 | Lio | 16/115 |

*Primary Examiner*—P. Austin Bradley
*Assistant Examiner*—Chuck Y. Mah
*Attorney, Agent, or Firm*—Browdy and Neimark

[57] ABSTRACT

An improved pull handle for use on a trunk is provided with an inverted U shaped grasp handle which is engaged with a hollow rod at each end thereof. Each hollow rod is inserted into a positioning tube. One of the positioning tubes is provided with a plurality of spaced slots thereon. An elongated rod having a press button associated with the top thereof is inserted into one of the hollow rods and a cam member is secured to the bottom end of the spring biased actuation rod. The cam member housed in a sleeve member having a slot disposed at the bottom thereof is in abutment against a spring biased base seat which is provided with a tilted surface in correspondence to the cam member. The base seat is supported in place by a round plate in the sleeve member. An extension tongue is disposed on the base seat and can stick out of or retract from the slot of the sleeve member and also the slots of the positioning tube when actuated by the cam member to slide outwardly or inwardly in the sleeve member. So, the length of the pull handle can be adjusted and be firmly retained at that adjusted length by way of the engagement of the extension tongue with the selected slot on the positioning tube.

1 Claim, 4 Drawing Sheets

PULL HANDLE OF A TRUNK

BACKGROUND OF THE INVENTION

The present invention relates to an improved pull handle of a trunk carried on a journey characterized by that an inverted U shaped grasp handle is provided with a hollow rod at each end thereof, and an actuation rod having a spring biased press button disposed at one end and a cam member mounted at the bottom end thereof is housed in one of the hollow rod. Each hollow rod is housed in a positioning tube one of which has a plurality of spaced slots disposed thereon so as to permit an extension tongue of a spring biased base seat which is slidably moved back and forth and in engagement with one of the slots as a result of the actuation of the cam member on the base seat whereby the grasp handle can be adjustably extended or shortened as the press button is actuated and retained in place as the button is released by the selective engagement of the extension tongue with one of the slots.

As shown in FIG. 1, the conventional pull handle is provided with a handle body 10A having two extended legs 20A to each of which Is mounted a mushroom-shaped retainer 31A and a friction rubber piece 40A having an eccentric hole that are secured in place by a nut 50A. The adjustment of the length of the pull handle is effected by pulling or pushing the legs 20A against the friction rubber pieces 40A and the legs are also retained in place by the friction rubber pieces 40A.

There are several disadvantages associated with the prior art pull handle which are listed as follows:

1. The adjustment of this kind of pull handle is relatively difficult as the legs are moved against the friction rubber pieces in operation.

2. The friction rubber pieces are easily worn out with time, making the pull handle easily get loose in operation.

SUMMARY OF THE INVENTION

The primary object of the present invention is to provide an improved pull handle of a trunk which is easy to adjust and can be operated safely.

Another object of the present invention is to provide an improved pull handle of a trunk which is provided with a press button secured to the top end of an actuation rod having a cam member attached to the bottom end thereof; the cam member is in abutment against a spring biased base seat having an extension tongue which can engage with one of the slots disposed on a positioning tube in which a hollow rod is housed. The actuation rod is inserted in the hollow rod and the base seat can be controlled by the press button to engage with or disengage from the slots of the positioning tube so as to make the adjustment of the length of the pull handle easy and the operation of the same secure.

DETAILED DESCRIPTION OF THE PREFERRED EMBODIMENT

Figure 1:
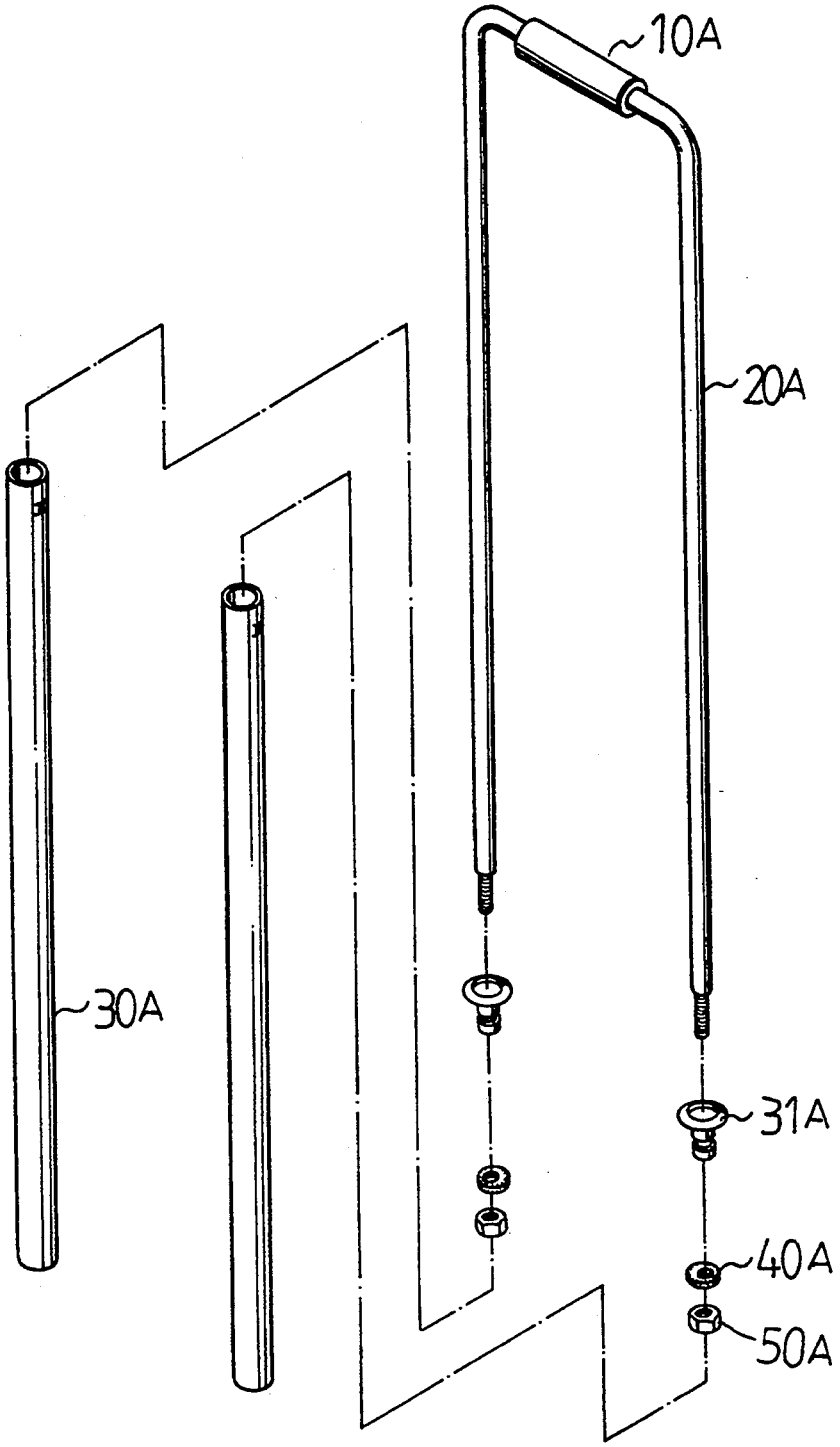
FIG.1 (PRIOR ART)
FIG. 1 is a diagram showing the prior art pull handle of a trunk.

Referring to FIGS. 2, 2A, 2B, 2C, the present pull handle mounted to a trunk is comprised of a grasp handle 10, a control means 20, a pair of hollow rods 30, and a pair of positioning tubes 40 and a sleeve member 50.

The grasp handle 10 has an inverted U shape and has a large hole 11 and a small hole 12 disposed at each end thereof. In the large hole 11 is housed a press button 21 and the small hole 12 is used as a fixing seat. To each end of the grasp handle 10 is secured a hollow rod 30 which is inserted into the respective positioning tube 40. One of the positioning tube 40 is provided with a plurality of spaced slots 42 thereon and a mushroom-shaped cap 41 is mounted to the top end thereof.

Figure 2A:
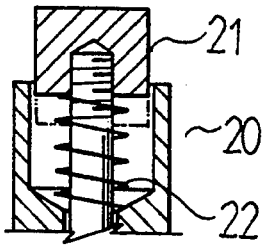
FIG. 2A is a sectional view of the press button engaged with the top end of the actuation rod.
Figure 2B:
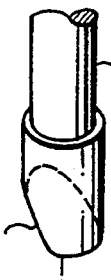
FIG. 2B is a diagram showing the cam member attached to the bottom end of the actuation rod.
Figure 2C:
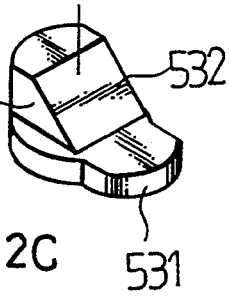
FIG. 2C is a diagram showing the base seat thereof.
Figure 2:
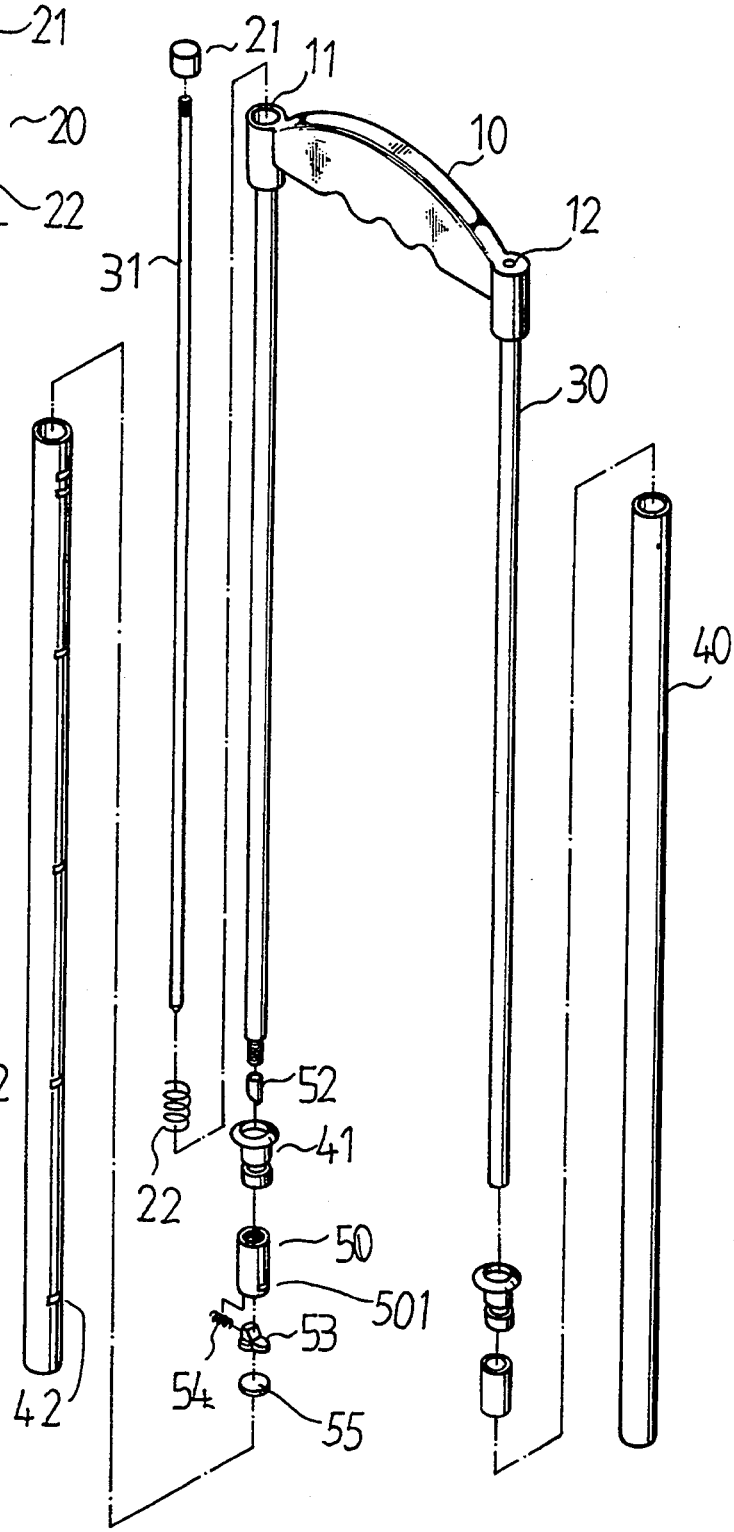
FIG. 2 is a perspective view of the exploded components of the improved pull handle of the present invention.
Figure 3:
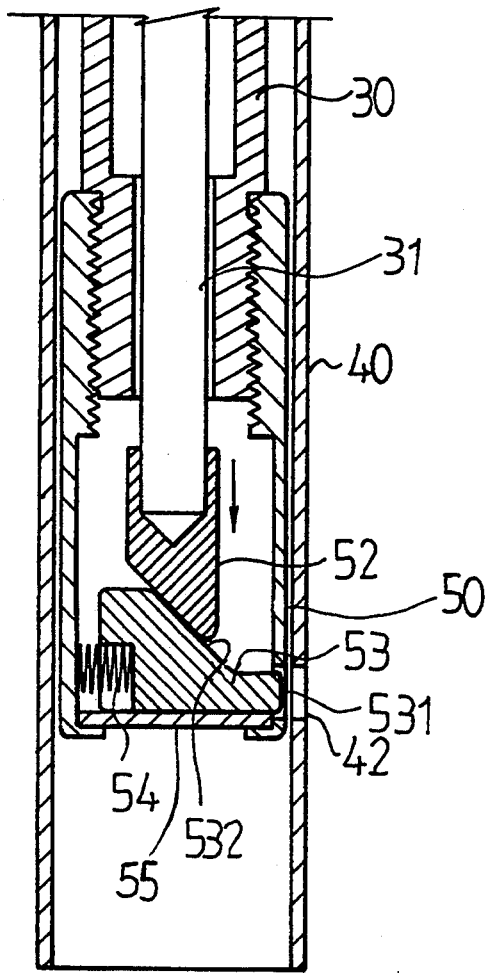
FIG. 3 is a sectional view showing the extension tongue of the base seat out of engagement with the positioning tube.
Figure 4:
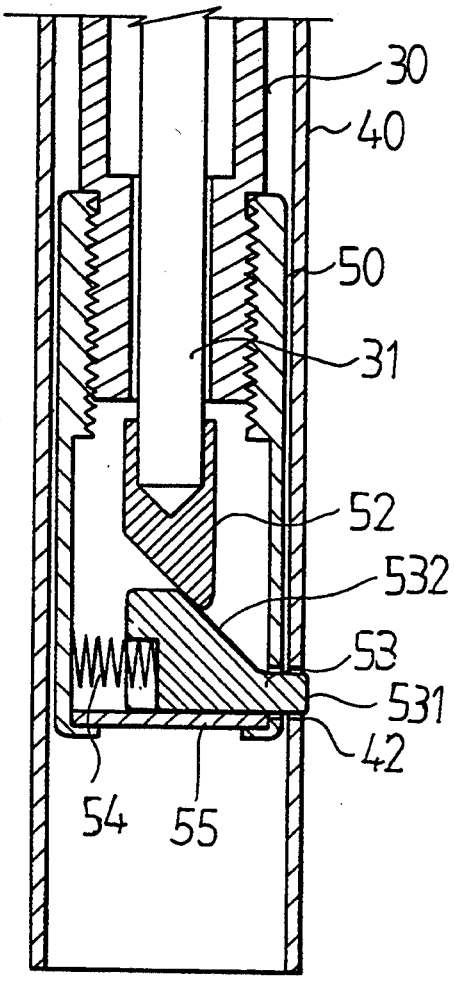
FIG. 4 is a sectional view showing the engagement of the extension tongue of the base seat with the positioning tube.

The control means 20 has a press button 21 in abutment with which is placed a spring 22 and an elongated rod 31 threadedly secured to the press button 21. To the bottom end of the actuation rod 31 is mounted a sloped cam member 52, as shown in FIGS. 2B, 3, 4. The sleeve member 50 having a slot 501 houses a base seat 53 biased by a spring 54 which is in slidable abutment against the cam member 52. The base seat 53 housed in the sleeve member 50 and supported in place by a supporting plate 55 is provided with a tilted surface 532 in correspondence to the cam member 52.

Referring to FIGS. 3, 4, the cam member 52 in slidable abutment with the base seat 53 can be actuated to move up and down by way of the press button 21 and the spring 22 so that the base seat 53 can be urged to slide forward and backward horizontally due to the tilted surface 532 and the bias spring 54. The base seat 53 is provided with an extension tongue 531 which can be selectively engaged with one of the slots 42 as the press button 21 is released and tile base seat 53 is brought to a proper position with the extension tongue 531 in alignment with one of the slots 42.

In summary, the actuation rod 31 secured to the press button 21 and biased by the spring 22 is engaged with the cam member 52 at the bottom end thereof which is in slidable abutment with the base seat 53. An extension tongue 531 on the base seat 53 can be actuated to move back and forth by the press button 21 whereby the pull grasp handle 10 associated with a pair of hollow rods 30 slidably inserted in the respective positioning tube 40 one of which has a plurality of slots 42 disposed thereon, can be outwardly pulled or inwardly pushed in operation with the extension tongues 531 of the base seats 53 selectively engaged with one of the slots 42 on the positioning tube 40, varying the length of the pull handle of a trunk.

I claim:

1. An improved pull handle for a trunk, comprising:

an inverted U-shaped grasp handle having two ends;

a pair of hollow rods each attached to one of said ends of said grasp handle;

an actuation rod disposed in one of said hollow rods;

a press button attached to a top end of said actuation rod;

a cam member disposed at a bottom end of said actuation rod;

a pair of positioning tubes in which said hollow rods are housed;

a mushroom-shaped cap being engaged with a top end of each said positioning tube;

a plurality of spaced slots disposed on the positioning tube in which said actuation rod is housed;

a sleeve member having a supporting plate disposed at a bottom end thereof;

a base seat disposed in said sleeve member and supported by said supporting plate;

said base seat being spring biased and slidably abutting against said cam member;

said base seat having a tilted surface on which said cam member can slidably move as said press button of said actuation rod is pushed downwardly or released so that said based seat can move back and forth in correspondence to the actuation of said press button and engage with or disengage from one of the slots on said positioning tube so as to permit said pull handle to be adjusted in length and retained in place at the adjusted position.

* * * * *